US006902006B2

(12) United States Patent
Myerley et al.

(10) Patent No.: US 6,902,006 B2
(45) Date of Patent: Jun. 7, 2005

(54) LOCK OPEN AND CONTROL SYSTEM ACCESS APPARATUS AND METHOD FOR A DOWNHOLE SAFETY VALVE

(75) Inventors: Thomas S. Myerley, Broken Arrow, OK (US); Scott C. Strattan, Tulsa, OK (US); Van J. McVicker, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 58 days.

(21) Appl. No.: 10/263,946

(22) Filed: Oct. 3, 2002

(65) Prior Publication Data

US 2004/0065442 A1 Apr. 8, 2004

(51) Int. Cl.[7] ..... E21B 43/12
(52) U.S. Cl. ..... 166/373; 166/332.8
(58) Field of Search ..... 166/332.8, 332.4, 166/318, 323, 373, 374, 375

(56) References Cited

U.S. PATENT DOCUMENTS

| | | | | |
|---|---|---|---|---|
| 2,974,922 A | | 3/1961 | Keithahn | |
| 4,420,041 A | | 12/1983 | Patel | |
| 4,437,516 A | | 3/1984 | Cockrell | |
| 4,566,541 A | * | 1/1986 | Moussy et al. | 166/318 |
| 4,574,889 A | | 3/1986 | Pringle | |
| 4,577,694 A | | 3/1986 | Brakhage, Jr. | |
| 4,585,067 A | | 4/1986 | Blizzard et al. | |
| 4,624,315 A | | 11/1986 | Dickson et al. | |
| 4,967,845 A | | 11/1990 | Shirk | |
| 5,249,630 A | | 10/1993 | Meaders et al. | |
| 5,310,005 A | | 5/1994 | Dollison | |
| 5,564,675 A | | 10/1996 | Hill, Jr. et al. | |
| 6,059,041 A | | 5/2000 | Scott | |
| 6,125,930 A | | 10/2000 | Moyes | |
| 6,575,249 B2 | * | 6/2003 | Deaton | 166/373 |
| 6,619,388 B2 | * | 9/2003 | Dietz et al. | 166/332.8 |
| 2001/0007284 A1 | | 7/2001 | French et al. | |

* cited by examiner

*Primary Examiner*—David Bagnell
*Assistant Examiner*—Matthew J. Smith
(74) *Attorney, Agent, or Firm*—Steve Rosenblatt

(57) ABSTRACT

A lock open device for a flapper is disclosed. The tool engages in the sub-surface safety valve (SSSV) body and rotates the flapper to the open position, without shifting the flow tube. The flapper base is preferably held by a shearable thread and has a groove for engagement by the tool. The tool jars down on the flapper base to shear the thread and force the held open flapper into a retaining groove. Optionally, a penetrating tool can be connected so that, in a single trip, the flapper can be locked open and the pressurized control system can be accessed. Shearing the thread allows the flow tube spring to bias the held open flapper into its retaining groove.

20 Claims, 22 Drawing Sheets

LOCK OPEN AND CONTROL SYSTEM ACCESS APPARATUS AND METHOD FOR A DOWNHOLE SAFETY VALVE

FIELD OF THE INVENTION

The field of this invention is lock open devices for sub-surface safety valves (SSSV) and related techniques for gaining access to the pressurized control system for subsequent operation of an inserted replacement.

BACKGROUND OF THE INVENTION

SSSVs are normally closed valves that prevent blowouts if the surface safety equipment fails. Conditions can arise where the SSSV fails to function for a variety of reasons. One solution to this situation has been to lock open the SSSV and to gain access into the pressurized control system that is used to move the flow tube to push the flapper into an open position against the force of a closure spring that urges the valve into a closed position. Thereafter, a replacement valve is delivered, normally on wireline, and latched into place such that the newly formed access to the control system of the original valve is now straddled by the replacement valve. This allows the original control system to be used to operate the replacement valve.

There have been several variations of lock open devices in the past. U.S. Pat. No. 4,577,694 assigned to Baker Hughes teaches the use of a flapper lock open tool (FLO) which delivers a band of spring steel to expand when retaining sleeves on the FLO tool are retracted. The tool latches inside the SSSV and with the flow tube in the flapper-closed position the band is released. This design offered the advantages of the lockout device not being integral to the SSSV. Instead it was only introduced when needed through a wireline. Another advantage was that the release of the band did no damage to the SSSV or the FLO tool. The band expanded into a recessed area so as to allow full-bore through-tubing access. The flow tube did not have to be shifted so that no spring forces acting on the flow tube had to be overcome to actuate the FLO tool. Subsequently, when the SSSV was retrieved to the surface, the band was easily removed by hand without special tools. The FLO tool had safety features to prevent premature release or incorrect placement. The FLO tool did not require fluid communication with the control system, as its purpose was solely flapper lock out.

The FLO tool did have some disadvantages. One was that the band could become dislodged under high gas flow rates. The tool was complicated and expensive to manufacture. The expanding ring presented design challenges and required stocking a large variety to accommodate different conditions. The running method required two wireline trips with jar-down/jar-up activation.

U.S. Pat. No. 4,574,889 assigned to Camco, now Schlumberger, required latching in the SSSV and stroking the flow tube down to the valve open position. The flow tube would then be outwardly indented in the valve open position so that the indentations would engage a downwardly oriented shoulder to prevent the flow tube from moving back to the valve closed position. This design had some of the advantages of the Baker Hughes FLO design and could accomplish the locking open with a single wireline trip. The disadvantages were that the flow tube was permanently damaged and that the flow tube had to be forced against a closure spring force before being dimpled to hold that position. This made disassembly of the SSSV with the flow tube under spring pressure a potentially dangerous proposition when the valve was later brought to the surface.

U.S. Pat. No. 5,564,675 assigned to Camco, now Schlumberger, also involved forcibly pushing the flow tube against the spring to get the flapper into the open position. In fact, the flow tube was over-stroked to push the actuator piston out of its bore in the pressurized control system, at which point the piston would have a portion splay out preventing its re-entry into the bore, thereby holding the flow tube in the flapper open position. This design had the safety issues of disassembly at the surface where the flow tube was under a considerable spring force. Additionally, fluid communication into the control system was not an option when locking open using this tool.

U.S. Pat. No. 6,059,041 assigned to Halliburton uses a tool that forces the flow tube down to get the flapper in the open position. It then releases a band above the flow tube that lodges on a downwardly oriented shoulder to hold the flapper open. This system has the risk of a flow tube under a spring force causing injury when later disassembled at the surface. This tool is fluid activated and must overcome the spring force to get the flow tube to the flapper open position. Finally, the tool is fluid pressure actuated, which will require a long fluid column to eventually communicate with the formation, a particular disadvantage in gas wells.

Also of interest in the area of lock open devices for SSSVs are U.S. Pat. Nos. 4,624,315; 4,967,845 and 6,125,930 (featuring collet fingers on the end of the flow tube that engage a groove in the SSSV body).

The present invention addresses these shortcomings by providing a technique to use a tool to get the flapper open without shifting the flow tube. In the preferred embodiment the flapper base is shifted with the flapper in the open position to trap the flapper in the open position. The closure spring that normally biases the flow tube into the flapper closed position is employed after the flapper base is liberated to bias the held-open flapper into its retaining grove. The lock open feature can be combined with stroking an oriented penetrating tool into the control system conduit for access to operate a subsequently installed valve to replace the locked open SSSV. The penetration step is not required to obtain the lock open state. Optionally the flapper base can be retained in its normal operating position by a shearable thread to allow taking advantage of a metal-to-metal sealing feature of the thread. These and other advantages of the present invention will become more readily apparent to those skilled in the art from a review of the description of the preferred embodiment and the claims appended below.

SUMMARY OF THE INVENTION

A lock open device for a flapper is disclosed. The tool engages in the sub-surface safety valve (SSSV) body and rotates the flapper to the open position, without shifting the flow tube. The flapper base is preferably held by a shearable thread and has a groove for engagement by the tool. The tool jars down on the flapper base to shear the thread and force the held open flapper into a retaining groove. Optionally, a penetrating tool can be connected so that, in a single trip, the flapper can be locked open and the pressurized control system can be accessed. Shearing the thread allows the flow tube spring to bias the held open flapper into its retaining groove.

DETAILED DESCRIPTION OF THE DRAWINGS

FIGS. 1*a*–1*e* are a section view of the SSSV in the closed position;

FIGS. 2*a*–2*e* are a section view of the SSSV with the lock open tool latched;

FIGS. 3*a*–3*e* show the collets freed at the base of the tool to push the flapper into the fully open position;

FIGS. 4*a*–4*e* are a section view showing the flapper base engaged by the tool just before the threads shear;

FIGS. 5*a*–5*e* are a section view with the flapper base sheared and the flow tube spring acting on the flapper base to retain the flapper in the lock open recess;

FIGS. 6*a*–6*e* show the SSSV in section with the lock open tool removed;

FIGS. 7*a*–7*c* shows the addition of the penetrating tool above the lock open tool;

DETAILED DESCRIPTION OF THE PREFERRED EMBODIMENT

Figure 1A:
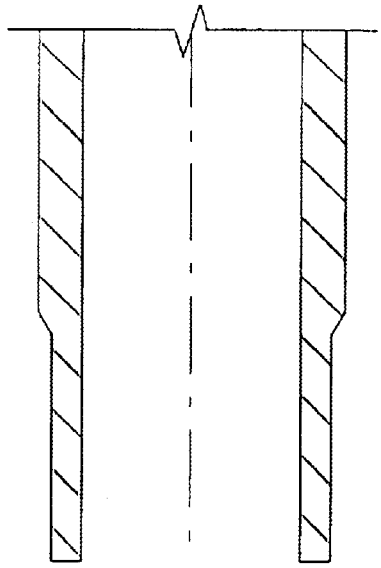
Figure 2A:
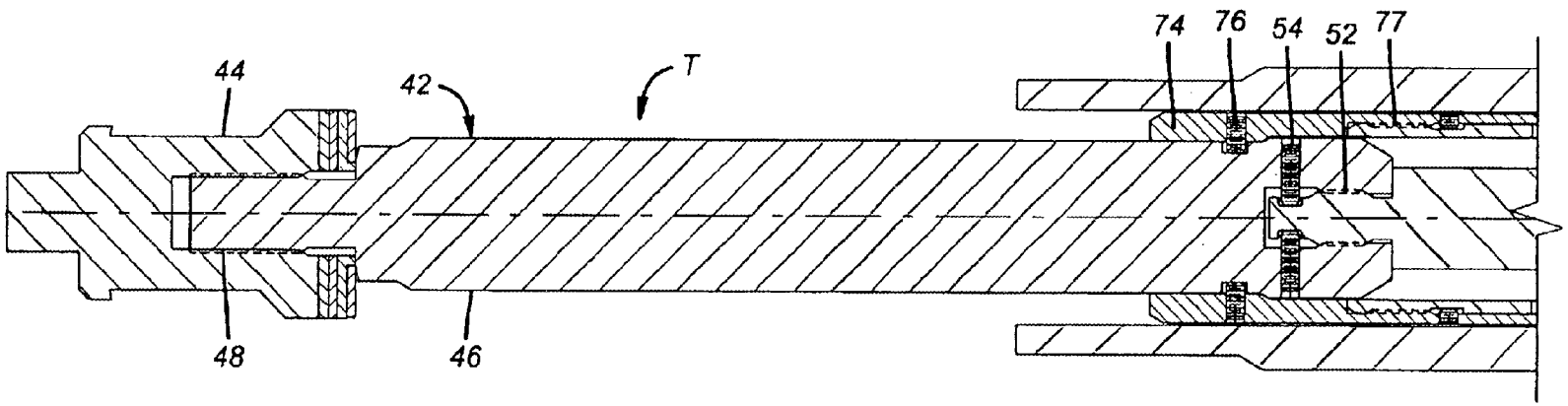
Figure 1B:
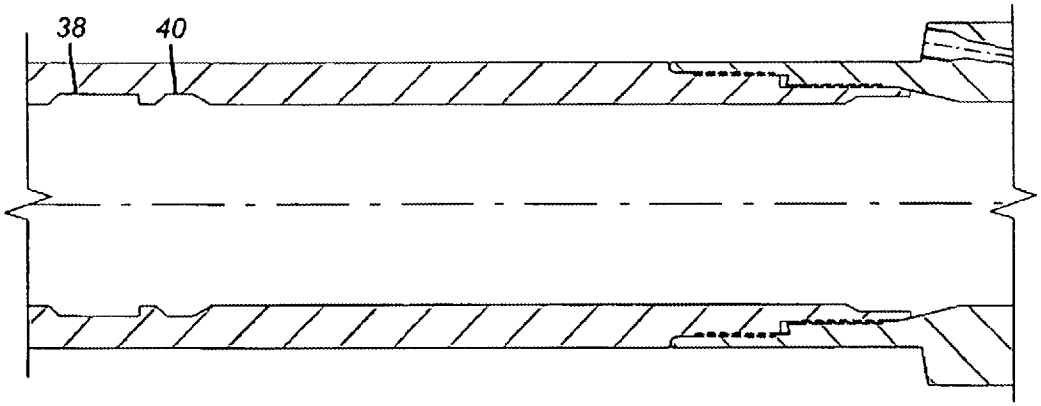
Figure 2B:
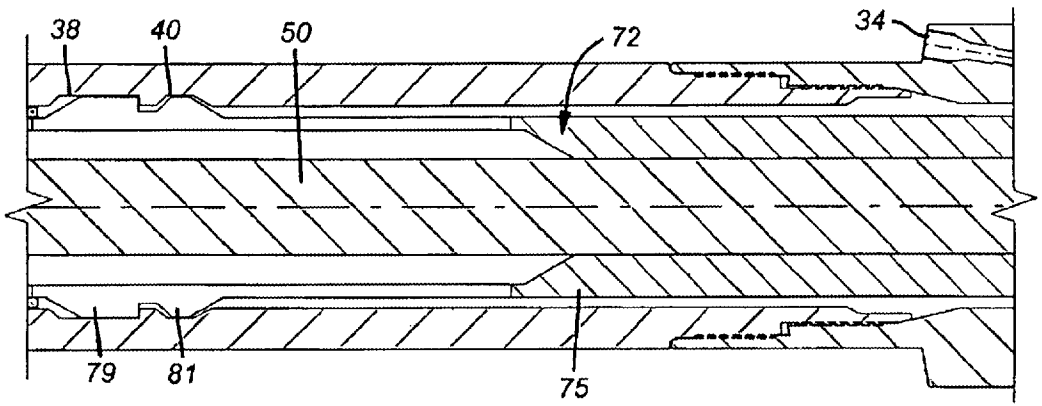
Figure 1C:
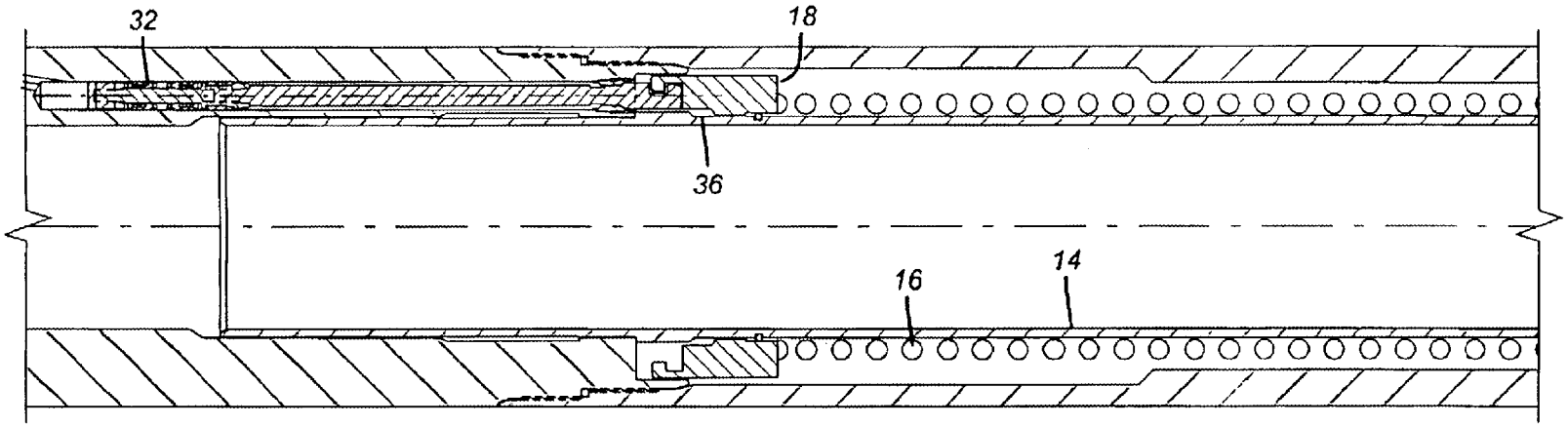
Figure 2C:
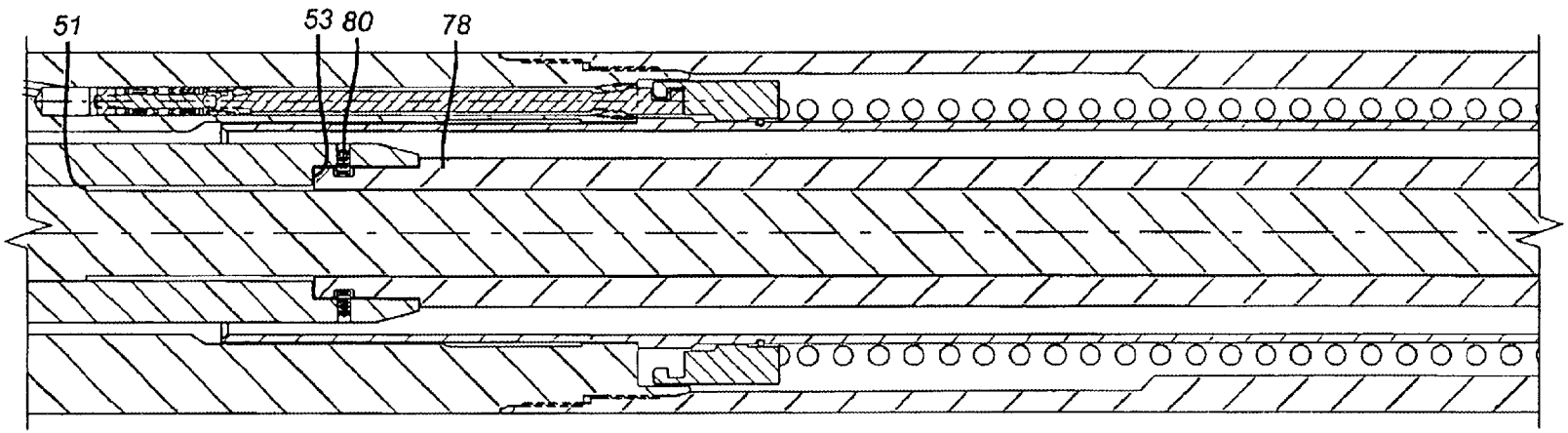
Figure 1D:
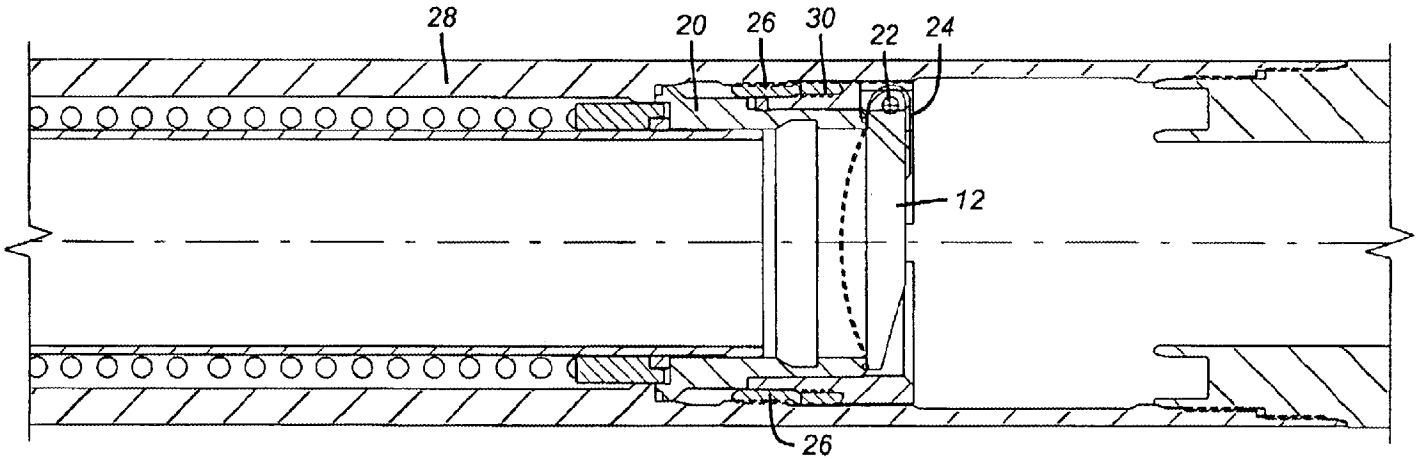
Figure 2D:
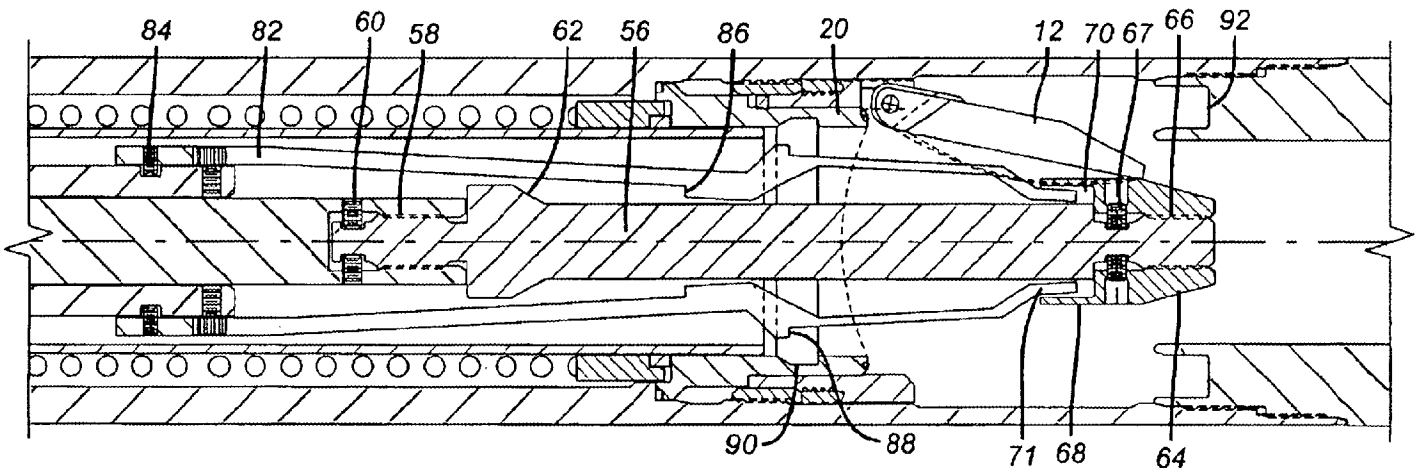
Figure 1E:
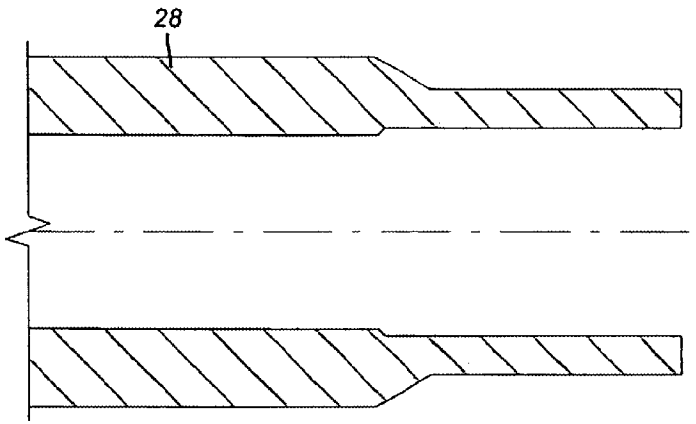
Figure 2E:
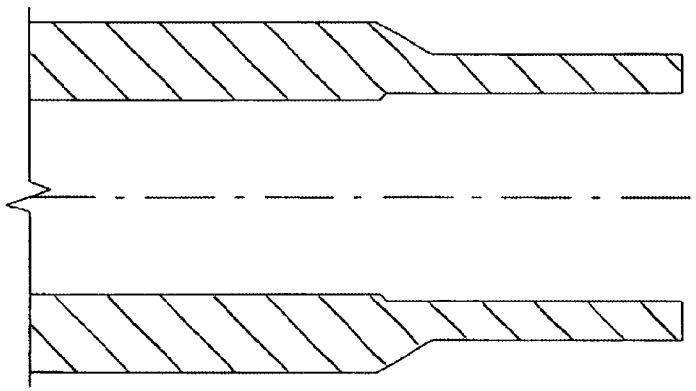
Figure 4A:
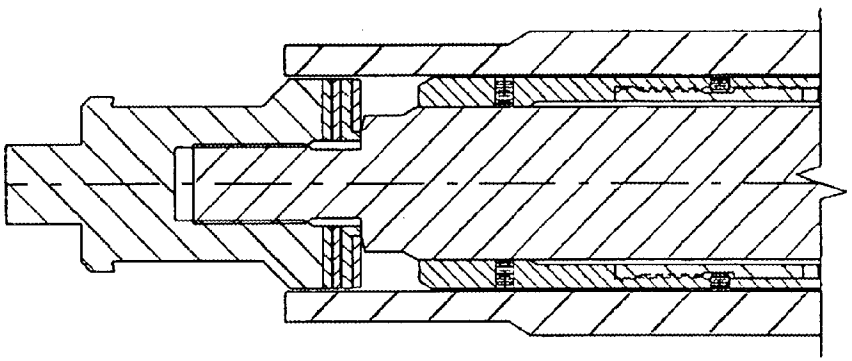
Figure 4B:
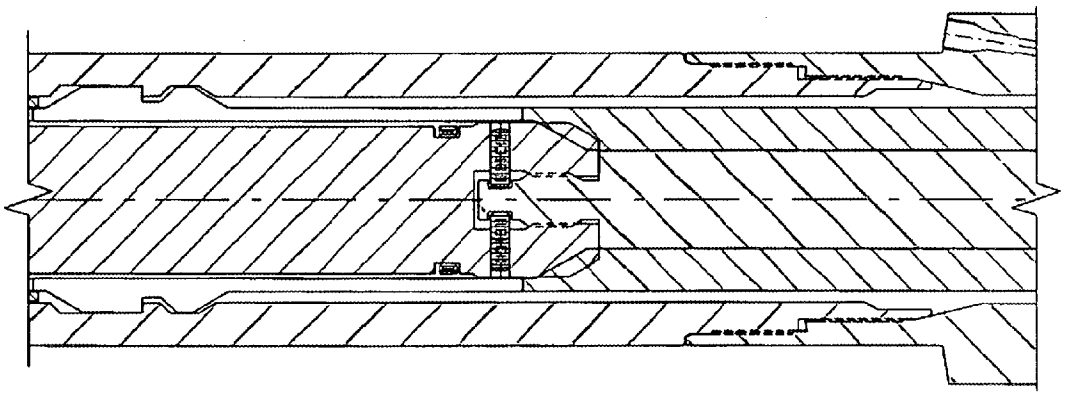
Figure 4C:
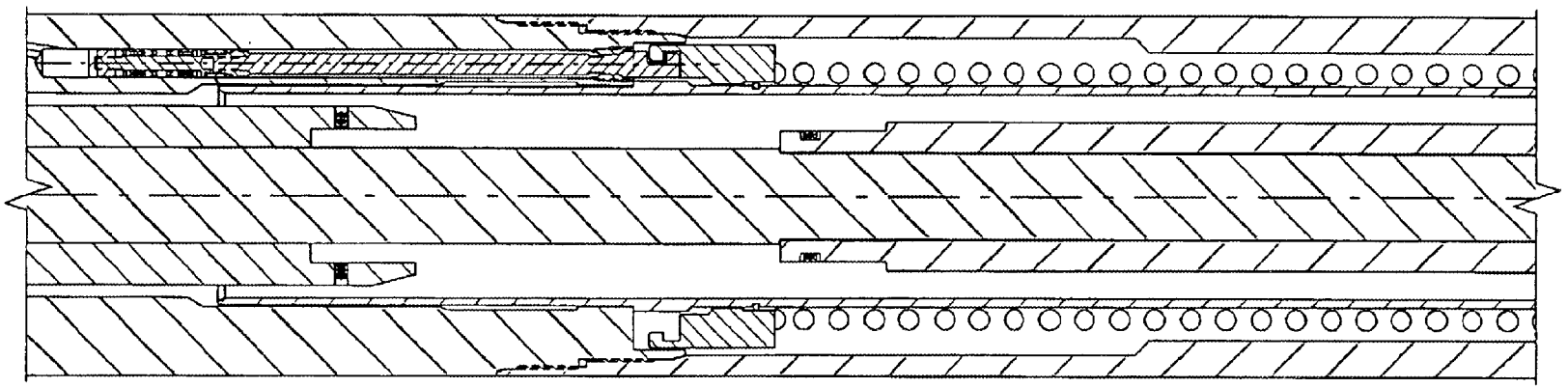

The sub-surface safety valve is illustrated in the closed position for the flapper 12, in FIG. 1. Spring 16 bearing on shoulder 18 biases the flow tube 14 upwardly. Flapper 12 is secured to flapper base 20 at pivot 22. Spring 24 biases flapper 12 to the closed position shown in FIG. 1*d*. Flapper base 20 is secured by sleeve 26 to body 28. That connection is preferably by a thread 30. Thread 30 is designed to release under a predetermined force applied to flapper base 20. Other retainers that selectively release such as shear pins or collets can be used instead of thread 30 as contemplated in alternative forms of the present invention. A piston 32 sees pressure from a control line extending from the surface (not shown) and connected to port 34. Piston 32 engages groove 36 to push the flow tube 14 down against the force of spring 16. Grooves 38 and 40 are for locating the lock open tool T as shown in FIG. 2*b*. FIG. 1*d* shows an enlargement of the area around thread 30.

FIGS. 2*a*–2*e* illustrate the initial insertion of the tool T. Tool T has a mandrel 42 made up of a top sub 44 connected to segment 46 at thread 48. Segment 50 is connected to segment 46 at thread 52 with the connection held locked by screws 54. Segment 56 is held to segment 50 at thread 58 with the connection locked by screws 60. Segment 56 further comprises a tapered shoulder 62. Collet retainer 64 is secured by thread 66 to segment 56 by screws 67. Collet retainer 64 comprises an extension segment 68 that defines an annular groove 70 in which the lower ends 71 of the collets 82 are disposed. The outer assembly 72 fits over the mandrel 42 and comprises a top sub 74 retained to segment 46 of mandrel 42 by a shear pin or pins 76. Segment 75 is retained to top sub 74 at thread 77. Projections 79 and 81 latch respectively into grooves 38 and 40 of body 28 due to the flexible nature of segment 75. Segment 78 is retained to segment 75 by a shear pin or pins 80. Collets 82 are secured to segment 78 by shear pin or pins 84. Collets 82 have an internal shoulder 86 for jarring down and an external shoulder 88 to engage groove 90 on flapper seat 20. Flapper seat 20 can be made of several interconnected parts. Spring 16 bears on flapper seat 20 for reasons to be explained below. Insertion of tool T results in a partial rotation of the flapper 12 toward the fully open position. The flapper is in the fully open position when in alignment with groove 92 in body 28*as* shown in FIGS. 3*d*–3*e*.

Figure 3A:
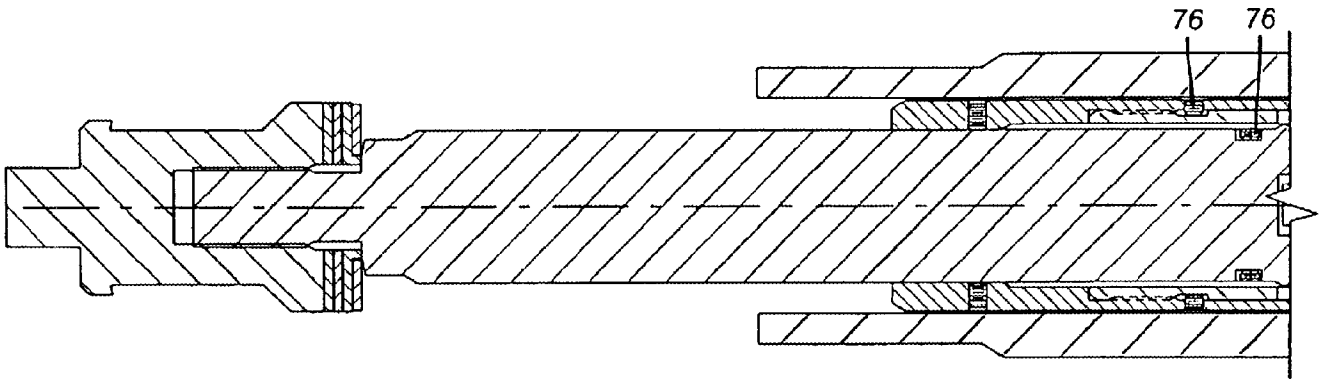
Figure 3B:
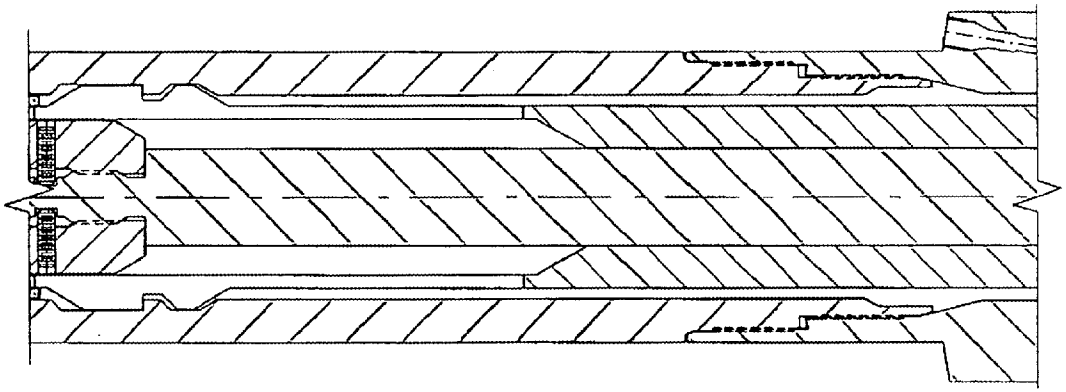
Figure 3C:
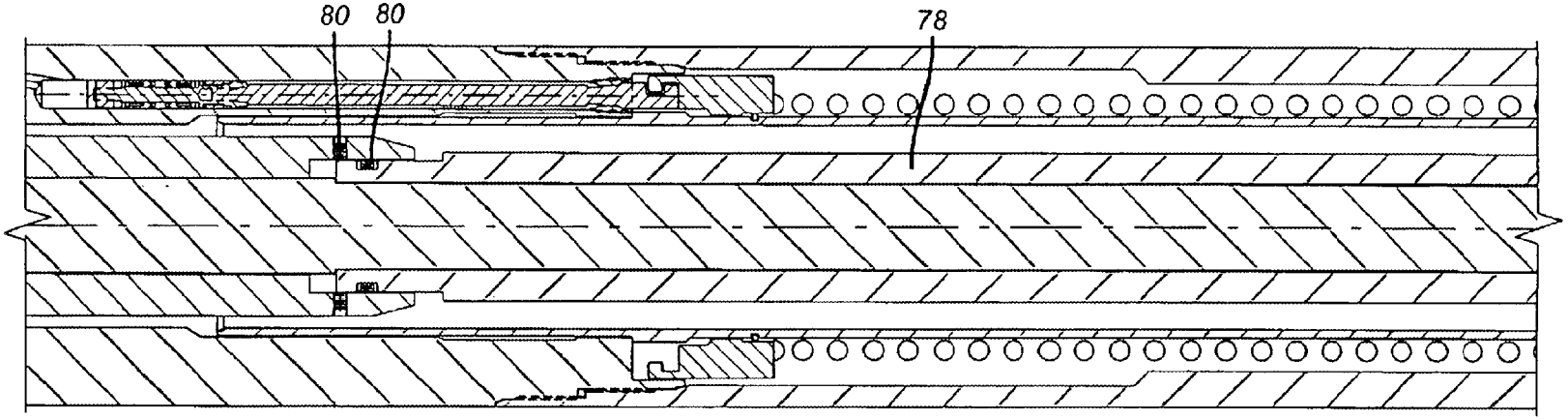
Figure 3D:
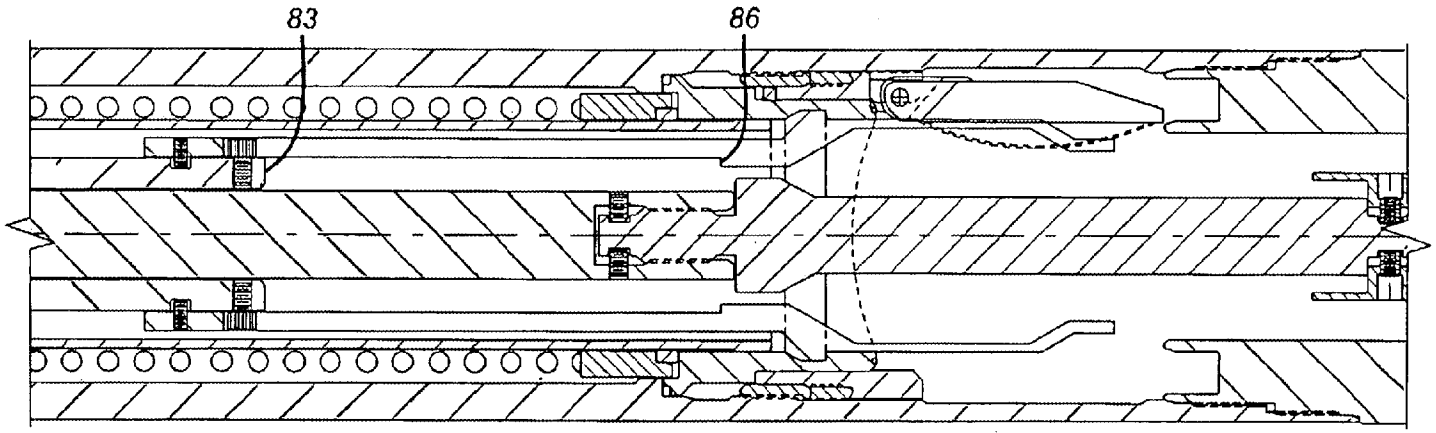
Figure 4D:
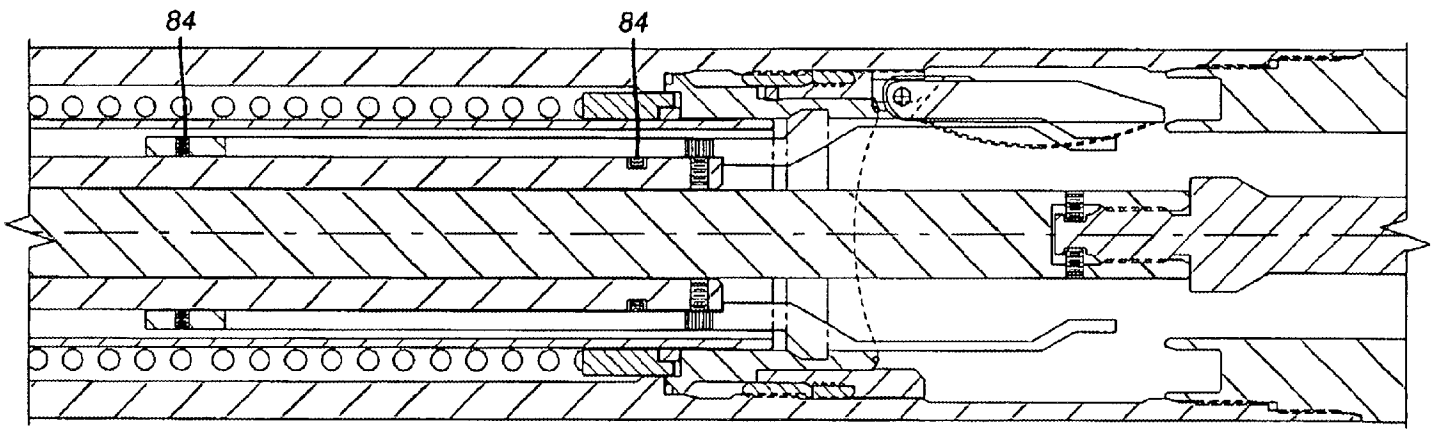
Figure 3E:
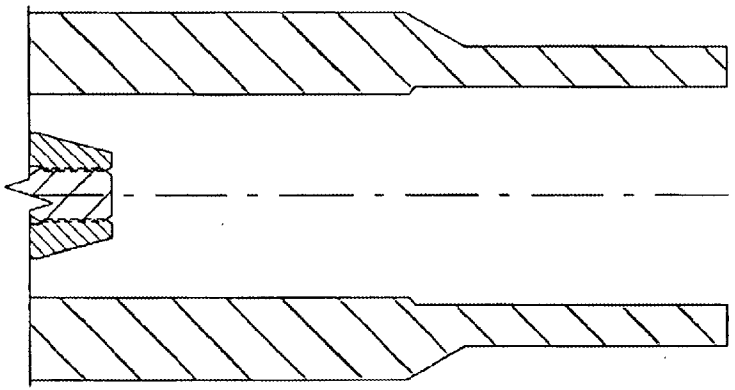
Figure 4E:
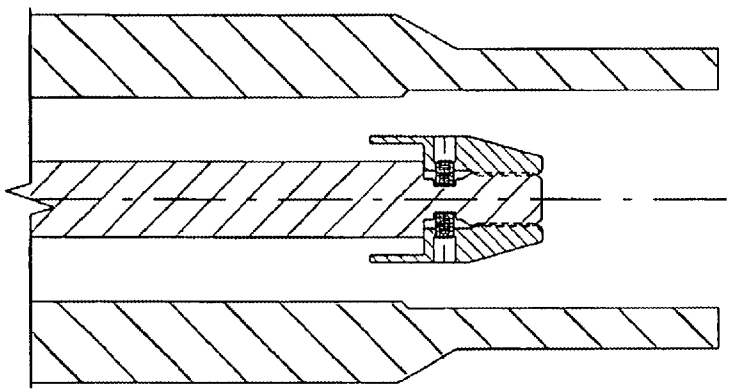
Figure 5A:
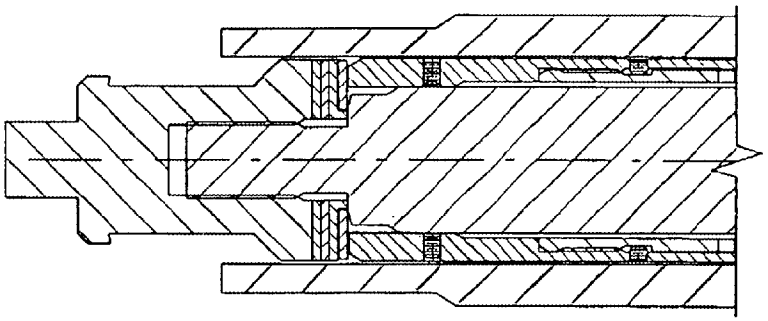
Figure 6A:
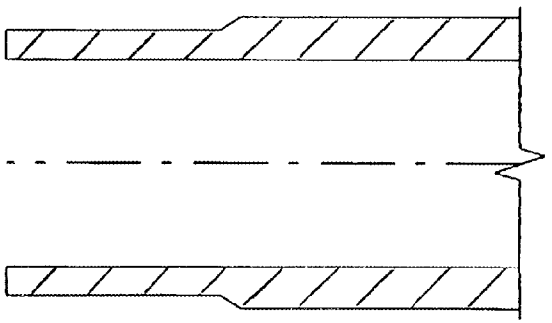
Figure 5B:
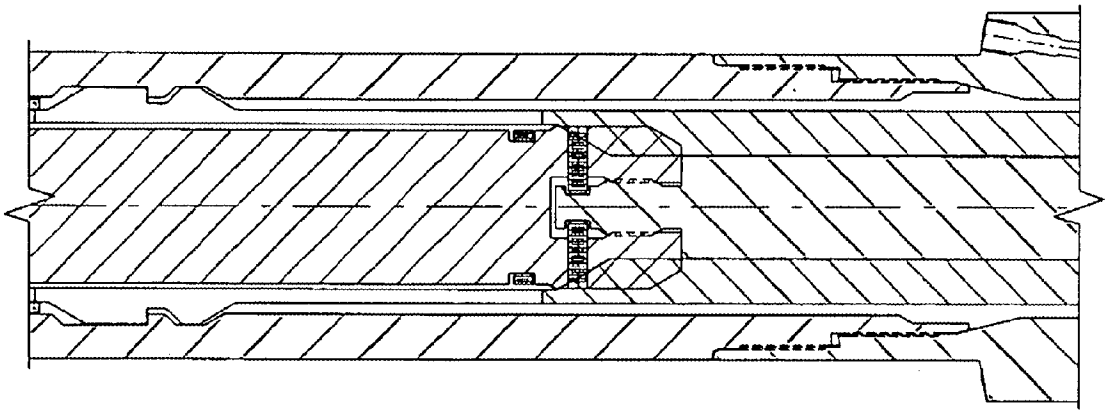
Figure 6B:
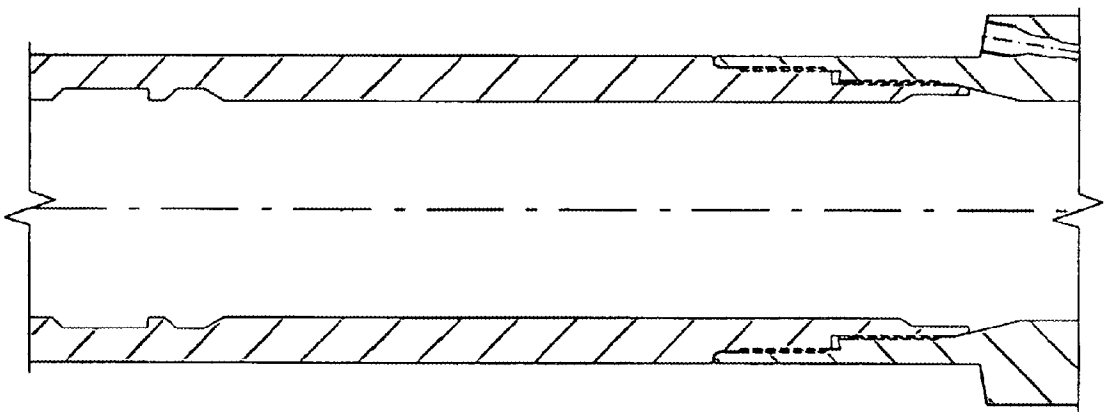
Figure 5C:
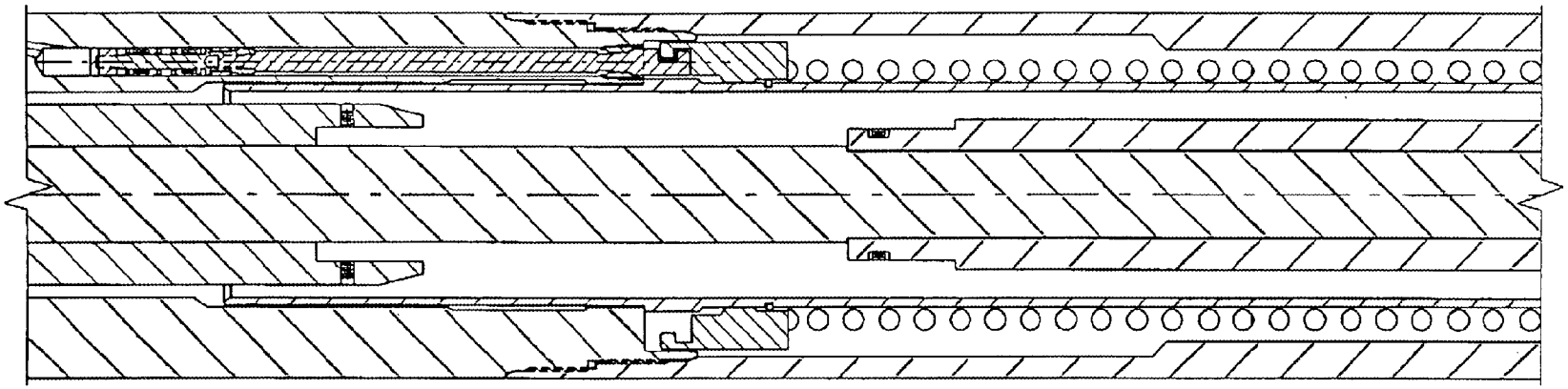
Figure 6C:
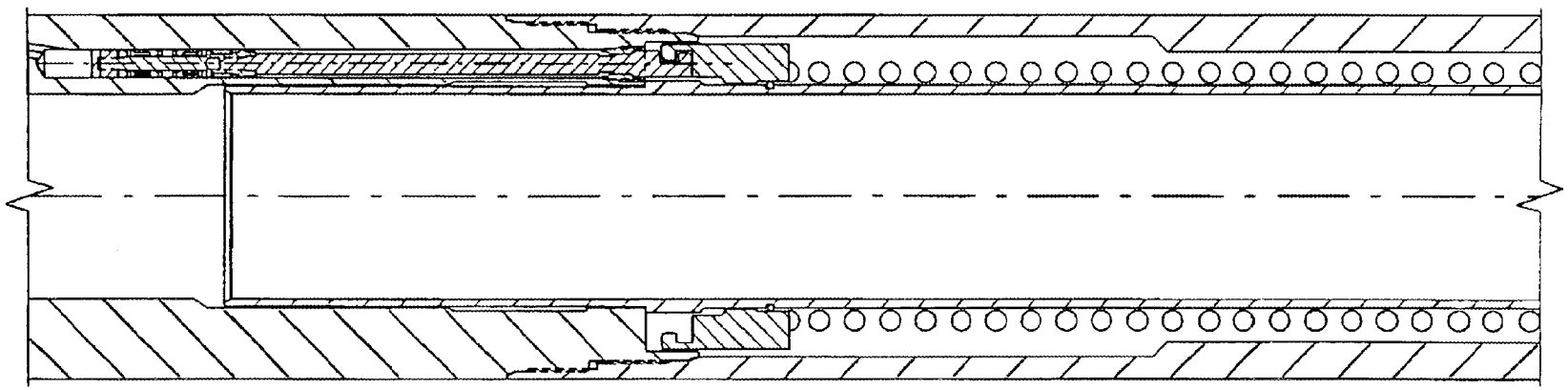
Figure 5D:
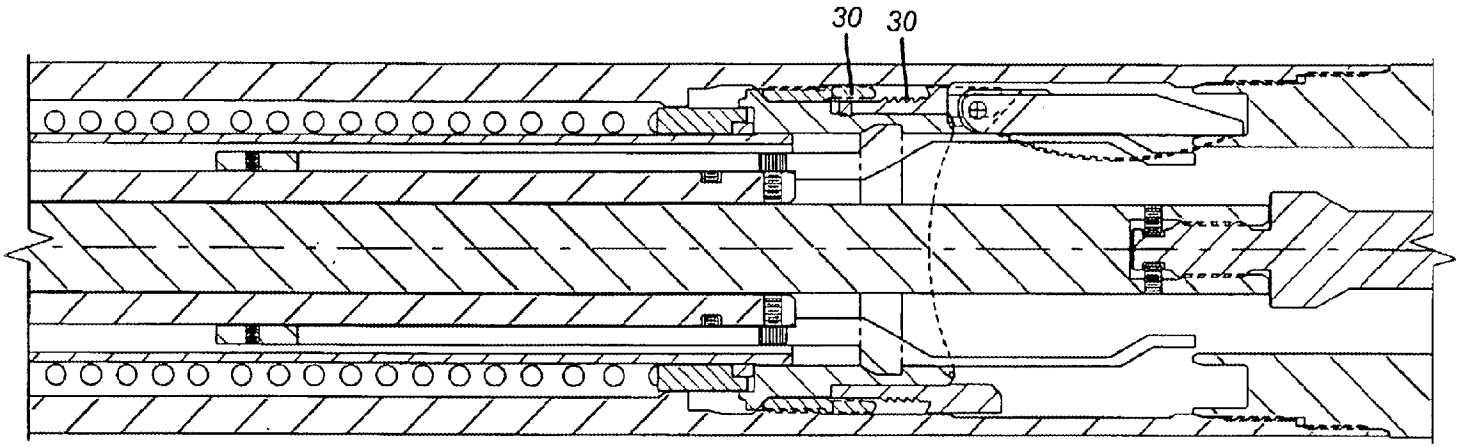
Figure 6D:
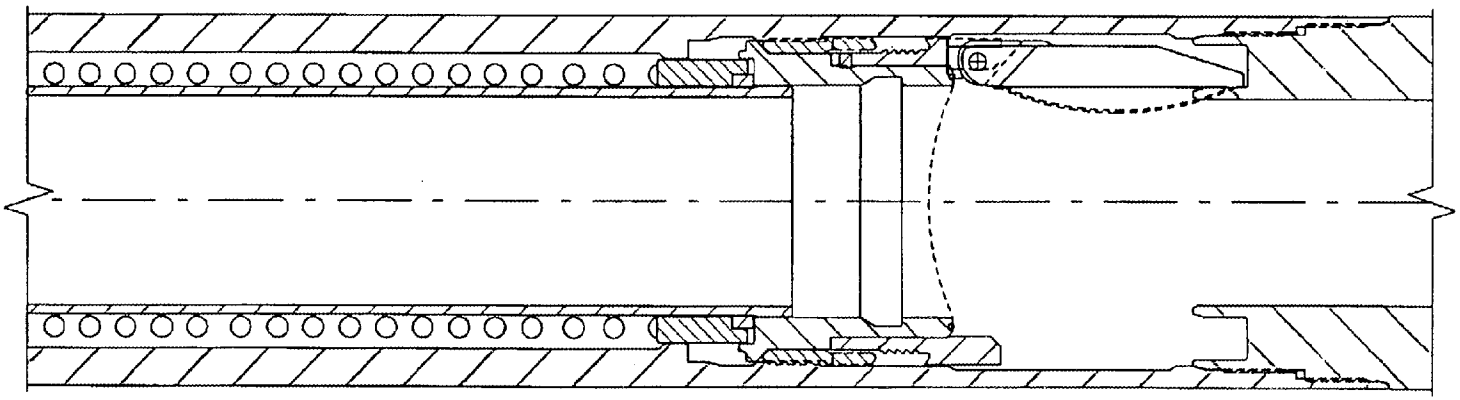
Figure 5E:
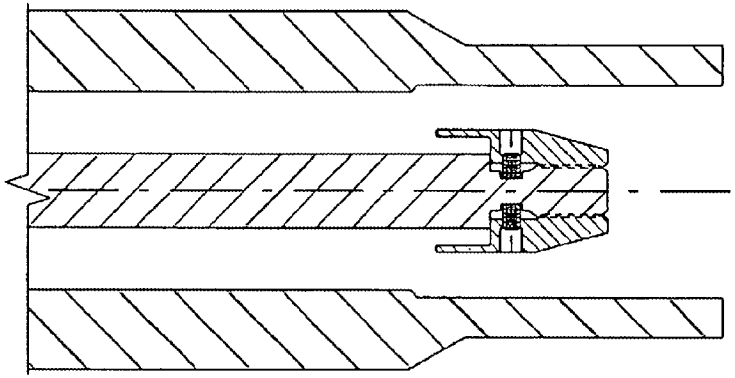
Figure 6E:
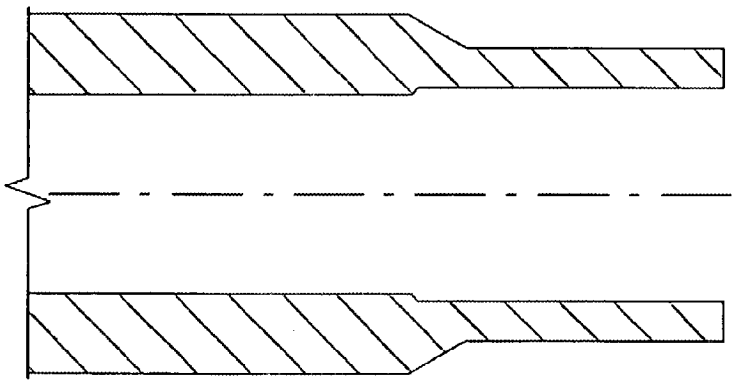

The significant components now having been described, the operation of the tool will be reviewed in detail. The tool T is lowered into the valve 10 until projections 79 and 81 spring into grooves 38 and 40 for latching contact. This position is shown in FIGS. 2*a*–2*b*. The collets 82 still have their lower ends 71 held by collet retainer 64, but the insertion itself has resulted in partial rotation of flapper 12 towards its fully open position. Actuating the mandrel 42 downwardly with a wireline operated jarring tool (not shown) connected to top sub 44 forces down the mandrel 42. Initially, shear pin or pins 76 break as the mandrel moves with respect to the outer assembly 72, which is supported to body 28 at grooves 38 and 40. Downward movement of the mandrel 42 moves collet retainer 64 away from lower ends 71 of collets 82, allowing them to spring radially outwardly so that shoulder 88 engages groove 90 in flapper seat 20. This is shown in FIG. 3*d*. The mandrel 42 continues moving down until shoulder 51 on segment 50 engages shoulder 53 on segment 78 of the outer assembly 72. At this time shear pin or pins 80 will break after the application of a predetermined force. When shear pin or pins 80 break, segment 78 of the outer assembly 72 is driven down until lower end 83 engages shoulder 86 on collets 82. By this time the collets 82 have pushed the flapper 12 into the fully open position so that it is in alignment with groove 92 in body 28. Movement of the lower end 83 of segment 78 breaks shear pin or pins 84, as shown in FIG. 4*d*. When a predetermined force is applied to shoulder 86 from lower end 83 the thread 30 holding flapper base 20 to sleeve 26 shears or otherwise fails and the flapper base 20 is driven down, now also with the help of spring 16 until the flapper 12 has entered groove 92. Spring 16 retains flapper 12 in groove 92. Collets 82 insure the alignment of flapper 12 with groove 92 as the flapper is driven down from the force of the jarring tool on the wireline (not shown) acting on mandrel 42 and from spring 16. The tool T can now be removed by an upward force on the wireline (not shown) and the flapped remains locked in groove 92 under the force of spring 16, as shown in FIGS. 6*a*–6*e*. The downward movement of flapper base 20 can be purely translation, as described for the preferred embodiment, or rotation or a combination of both movements to get the flapper 12 into groove 92.

Figure 7A:
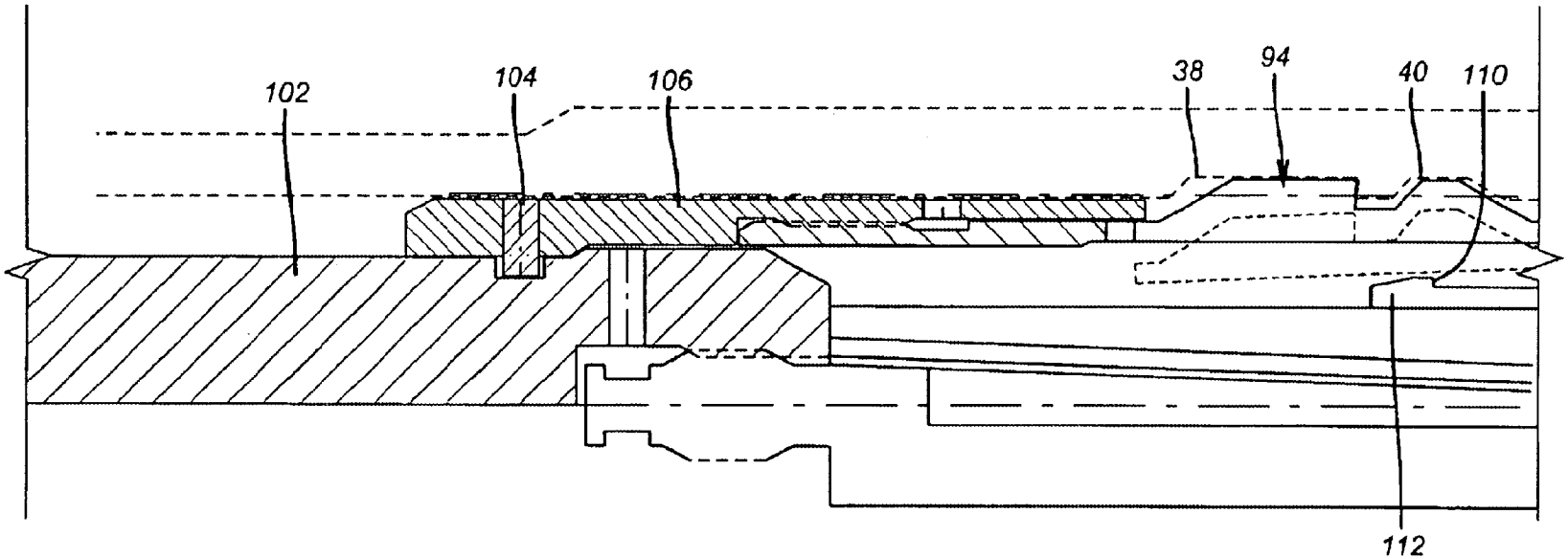
Figure 7B:
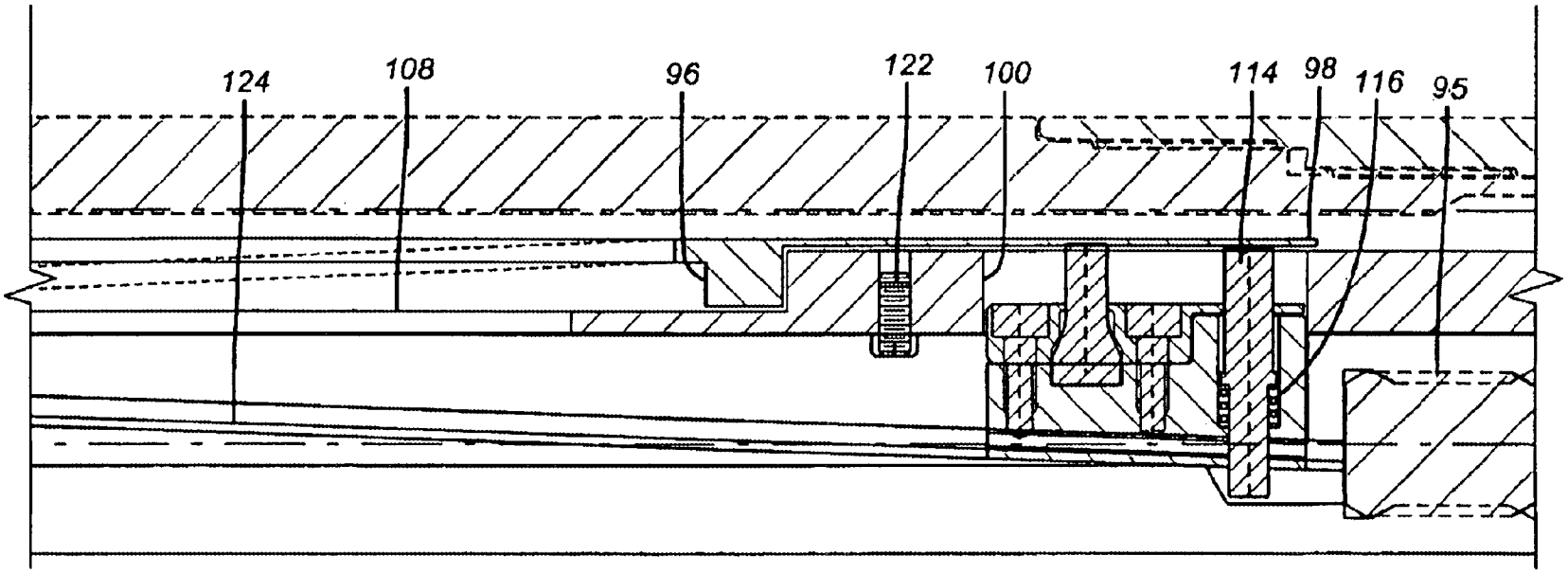
Figure 7C:
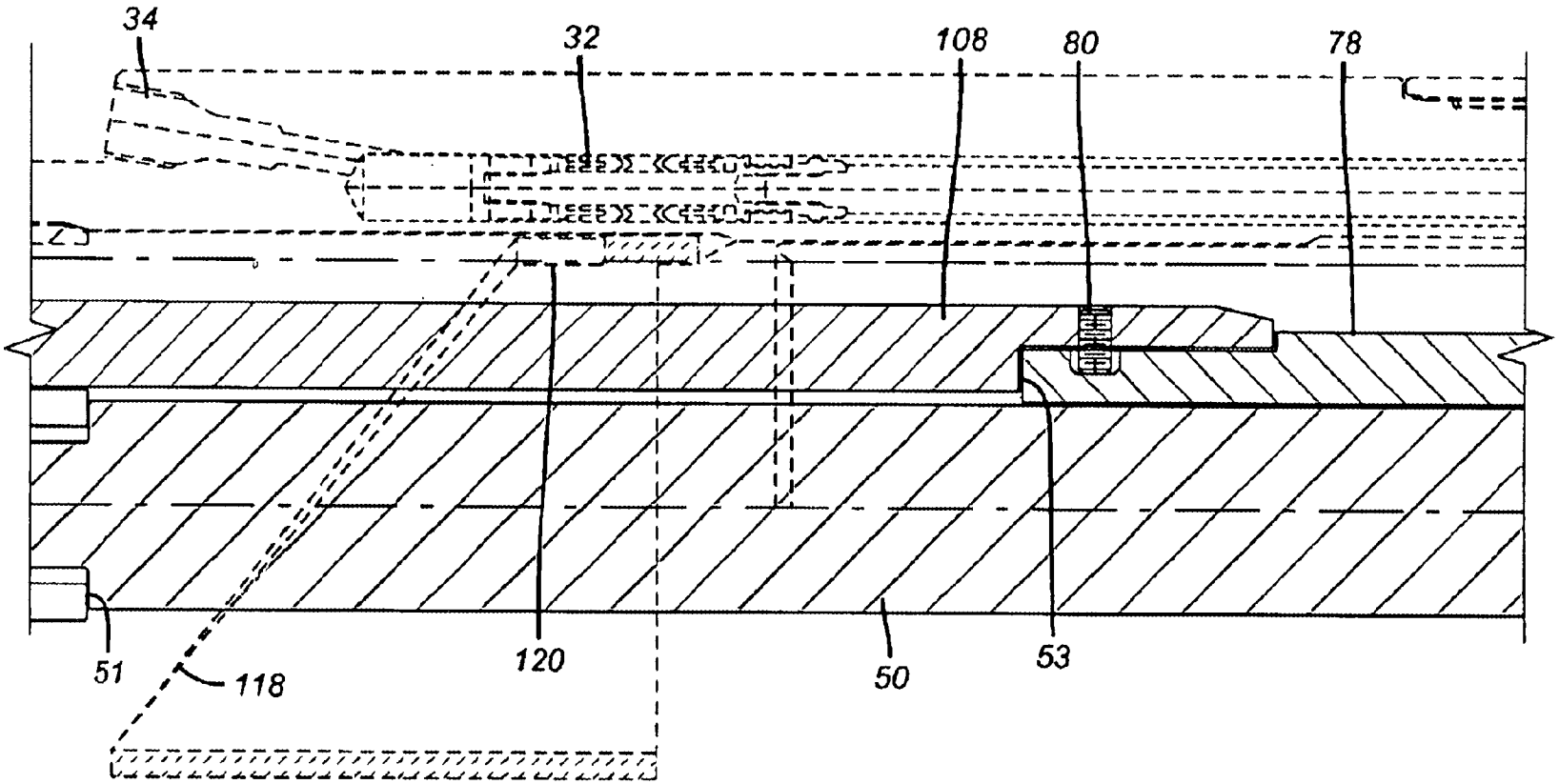
Figure 8:
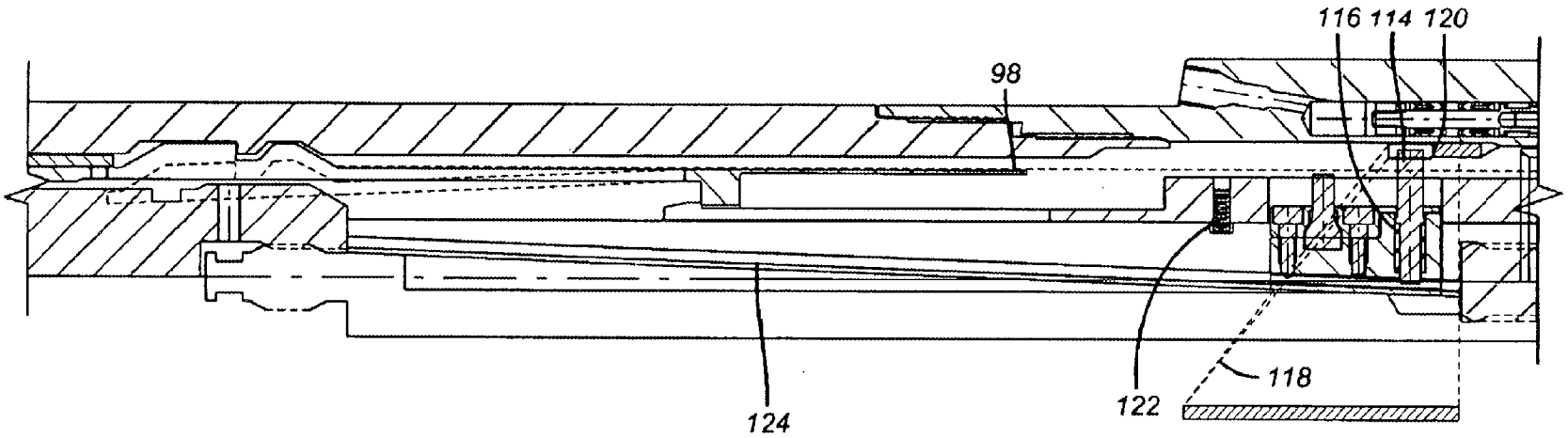
FIG. 8 is the penetrating tool after rotation.
Figure 9:
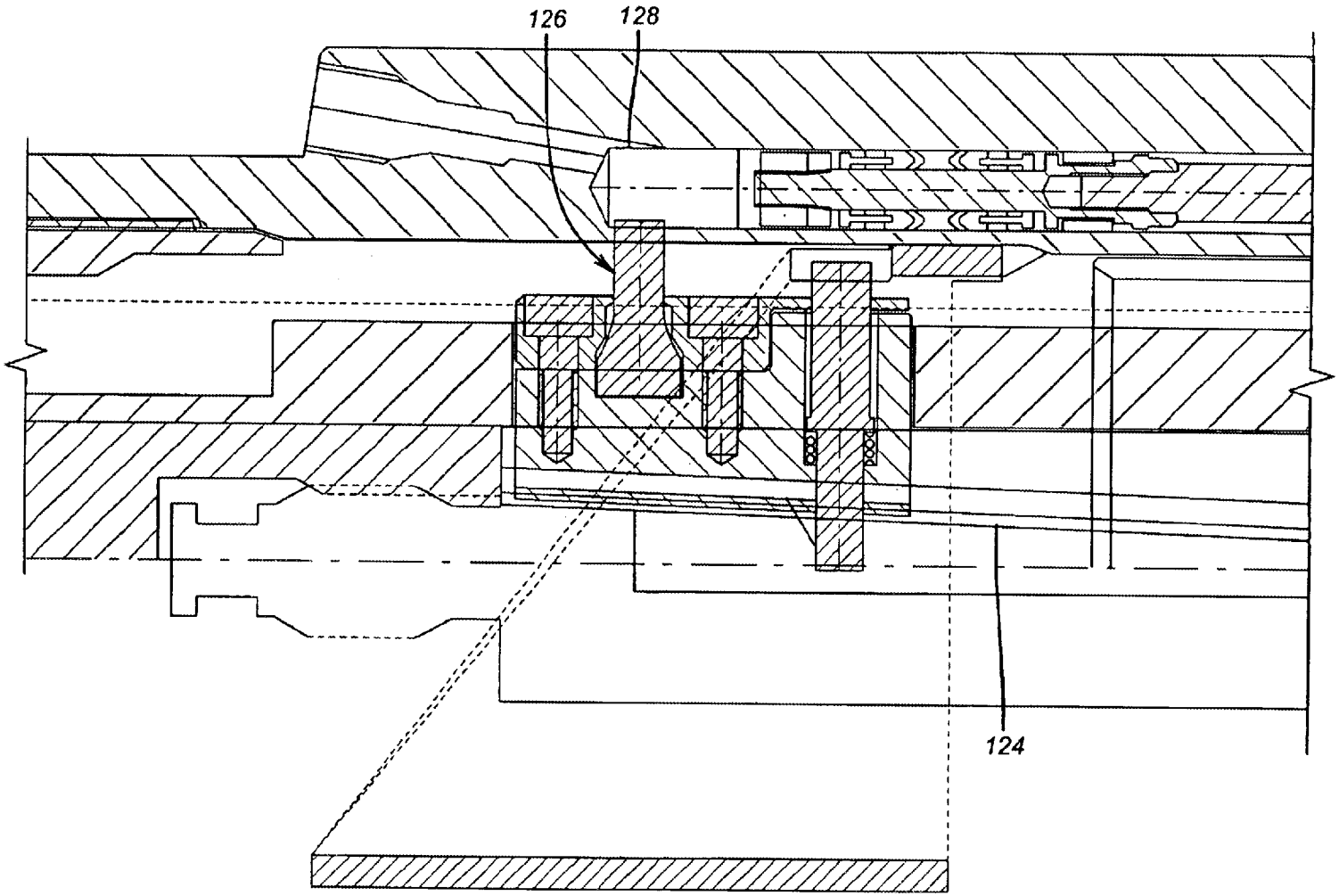
FIG. 9 is the penetrating tool after penetration.

Referring to FIGS. 7*a*–7*c*, the penetration tool P can be added above the lock open tool T. The lock open tool terminates near shoulder 51 at thread 95. The assembly of the tool T and the tool P are initially suspended in grooves 38 and 40 as collet 94 springs outwardly. Collet 94 comprises an internal shoulder 96 and a lower end 98, which covers window 100. Mandrel 102 is connected to the jarring tool (not shown). Shear pin 104 secures sleeve 106 to mandrel 102 so that the entire assembly is initially supported by collet 94. Outer housing 108 has an exterior shoulder 110 near its upper end 112. Window 100 is in outer housing 108. At its lower end 114, outer housing is attached by shear pin 80 to segment 78, as previously described. Guide pin 114 is biased by spring 116 but lower end 98 of collet 94 holds in pin 114 until shear pin 104 is broken. When mandrel 102 is advanced after shear pin 104 is broken, pin 114 is pushed out by spring 116 to contact spiral ramp 118 that is part of the SSSV. Such contact coupled with advancement of the mandrel 102 creates rotation as pin 114 advances along spiral ramp 118 and toward longitudinal groove 120. Eventually, all rotational movement is complete as pin 114 in groove 120 and shoulder 110 hits shoulder 96. This is the position in FIG. 8. Now shear pin 122 can break as mandrel 102 and wedge surface 124 push penetrator assembly 126 through window 100 and into control system 128 above piston 32 (see FIG. 9).

While the rotation to get alignment for penetration is going on, the tool T is opening the flapper 12 and latching into groove 90 as shown in FIGS. 2*e*–4*e*. When the penetration occurs the shear out of thread 30 occurs and the flapper 12 is displaced into groove 92. Thus both steps can occur in a single trip or either step can be done individually without the other.

Figure 10:
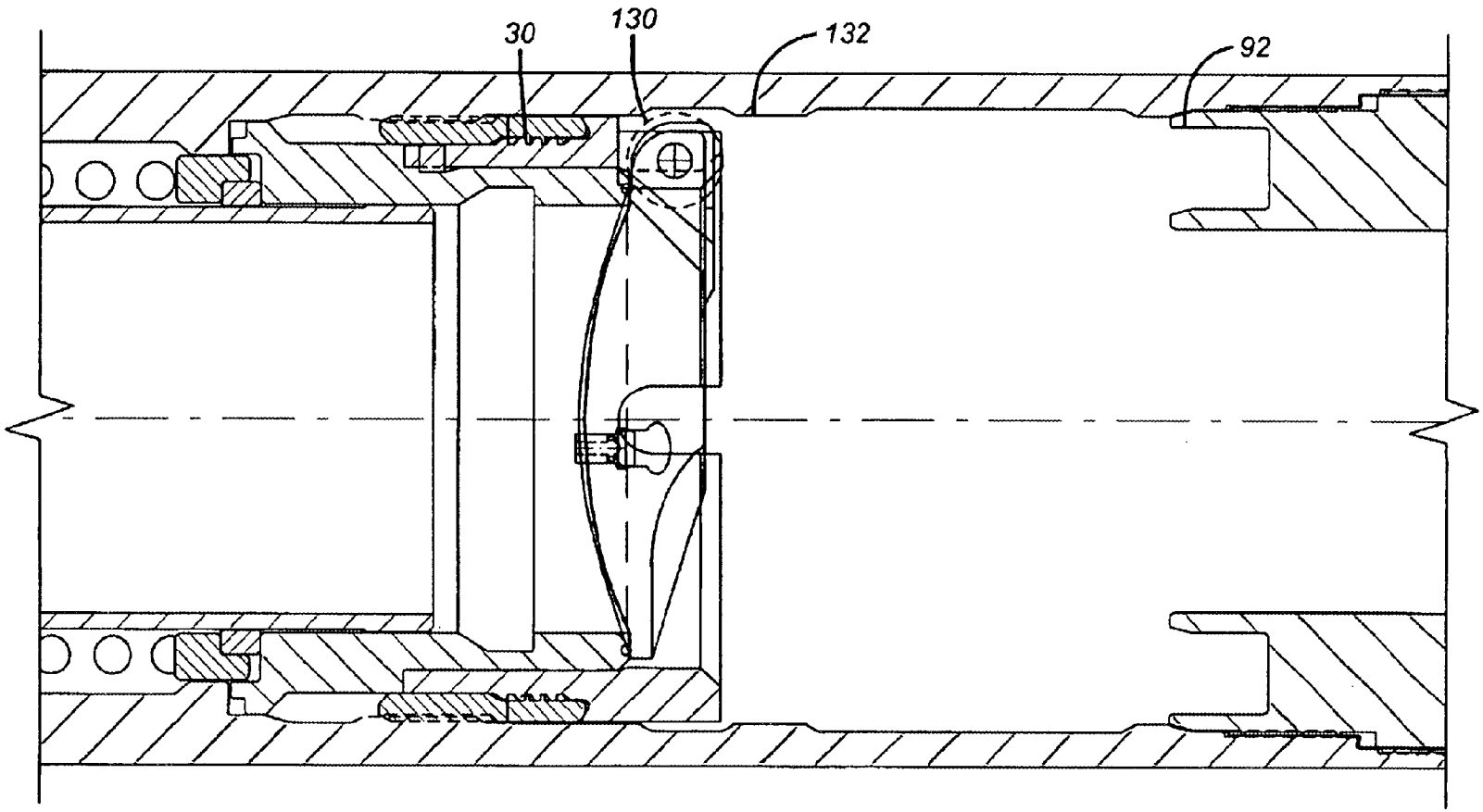
FIG. 10 shows the flapper in the normal operating closed position with an enlarged hinge diameter.
Figure 11:
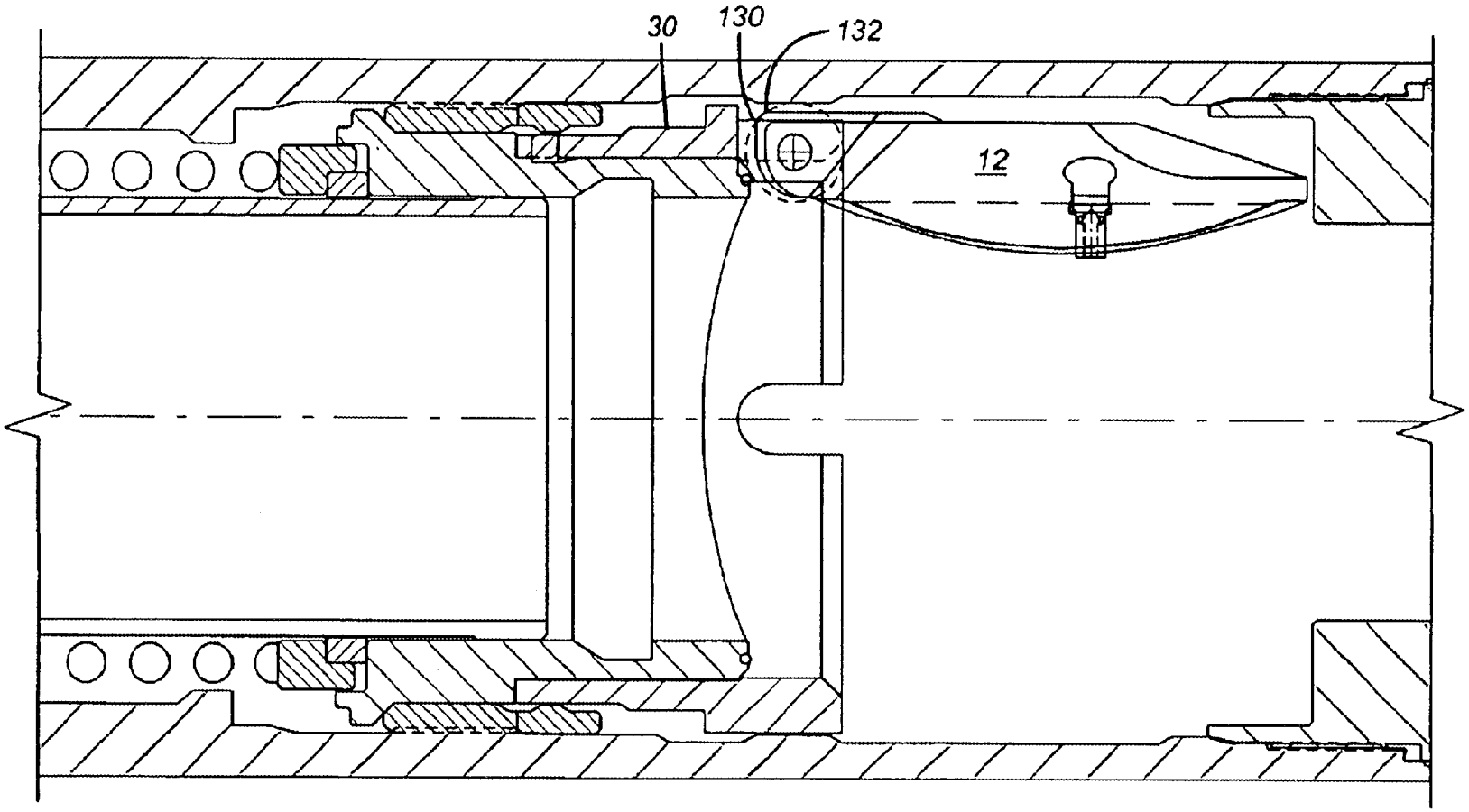
FIG. 11 is the view of FIG. 10 with the enlarged hinge diameter forced down into interference with an adjacent reduced bore diameter.

FIGS. 10 and 11 show a variation of holding the flapper 12in the open position. It can be held open with a combination of groove 92, as previously described as well as an enlarged diameter hinge 130 that is forced down into a reduced diameter segment 132 for an interference fit. FIG. 11 shows that groove 92 can be eliminated and the interference fit between hinge 130 and reduced diameter segment 132 can be the sole mechanism to insure the flapper 12 stays open after the thread 30 is sheared out.

The foregoing disclosure and description of the invention are illustrative and explanatory thereof, and various changes in the size, shape and materials, as well as in the details of the illustrated construction, may be made without departing from the spirit of the invention.

We claim:

1. A method of taking a well safety valve out of service, comprising:

providing a housing comprising a hinged flapper actuated by a flow tube where the flow tube is biased by a flow tube spring against a pressure control system;

mounting said flapper on a base;

positioning said flapper in the open position;

moving said flapper base after said positioning.

2. The method of claim 1, comprising:

penetrating into said pressurized control system in said housing in the same trip into the wellbore as said moving of said flapper base.

3. A method of taking a well safety valve out of service, comprising:

providing a housing comprising a hinged flapper actuated by a flow tube where the flow tube is biased by a flow tube spring against a pressure control system;

mounting said flapper on a base;

positioning said flapper in the open position;

moving said flapper base;

providing retaining groove in said housing;

shifting said flapper into said groove.

4. The method of claim 2, comprising:

biasing said flapper as a result of said shifting said flapper.

5. A method of taking a well safety valve out of service, comprising:

providing a housing comprising a hinged flapper actuated by a flow tube where the flow tube is biased by a flow tube spring against a pressure control system;

mounting said flapper on a base;

positioning said flapper in the open position;

moving said flapper base;

biasing said flapper as a result of said moving of said flapper base;

biasing said flapper after said moving of said flapper base.

6. A method of taking a well safety valve out of service, comprising:

providing a housing comprising a hinged flapper actuated by a flow tube where the flow tube is biased by a flow tube spring against a pressure control system;

mounting said flapper on a base;

positioning said flapper in the open position;

moving said flapper base;

providing a reduced diameter section in the valve housing;

forcing a portion of said flapper into an interference fit in said reduced diameter section to hold it open.

7. A method of taking a well safety valve out of service, comprising:

providing a housing comprising a hinged flapper actuated by a flow tube where the flow tube is biased by a flow tube spring against a pressure control system;

mounting said flapper on a base;

positioning said flapper in the open position;

moving said flapper base;

providing a reduced diameter section in the valve housing;

forcing a portion of said flapper into an interference fit in said reduced diameter section to hold it open;

using the hinge portion of said flapper to create said interference fit.

8. A method of taking a well safety valve out of service, comprising:

providing a housing comprising a hinged flapper actuated by a flow tube where the flow tube is biased by a flow tube spring against a pressure control system;

mounting said flapper on a base;

positioning said flapper in the open position;

moving said flapper base;

selectively securing said base to the housing of the valve; and releasing said base from said housing to allow moving of said flapper base.

9. The method of claim 8, comprising:

using a thread for said selective securing; and shearing said thread.

10. The method of claim 8, comprising:

using at least one shear pin for said selective securing; and shearing said pin.

11. The method of claim 8, comprising:

supporting one end of said flow tube spring on said base: and biasing said base with said flow tube spring after said releasing of said base.

12. The method of claim 8, comprising:

inserting a flapper tool into the valve;

pushing said flapper toward its open position with said tool.

13. The method of claim 12, comprising:

intially retaining at least one outwardly biased collet on a mandrel of said tool;

releasing said collet;

fully moving said flapper to the open position with said collet.

14. The method of claim 13, comprising:

engaging said base with said collet;

shifting said mandrel with said collet engaging said base to accomplish said releasing of said base from said housing.

15. The method of claim 14, comprising:

using a thread for said selective securing; and shearing said thread.

16. The method of claim 14, comprising:

supporting one end of said flow tube spring on said base: and biasing said base with said spring after said releasing of said base.

17. The method of claim 16, comprising:

providing a retaining groove in said housing of the valve;

shifting said flapper into said groove.

18. The method of claim 17, comprising:

providing a reduced diameter section in said housing;

forcing a portion of said flapper into an interference fit in said reduced diameter section to hold it open.

19. The method of claim 16, comprising;

providing a reduced diameter section in said housing;

forcing a portion of said flapper into an interference fit in said reduced diameter section to hold it open.

20. The method of claim 16, comprising:

attaching a penetration tool to said flapper tool;

orienting said penetration tool to the pressurized control system;

penetrating into said control system.

* * * * *